US008662135B2

(12) United States Patent
Lin

(10) Patent No.: US 8,662,135 B2
(45) Date of Patent: Mar. 4, 2014

(54) STRING-GUIDING STRUCTURE FOR A CURTAIN-REELING DEVICE

(76) Inventor: Shih-Ming Lin, Chiayi (TW)

( * ) Notice: Subject to any disclaimer, the term of this patent is extended or adjusted under 35 U.S.C. 154(b) by 0 days.

(21) Appl. No.: 13/474,776

(22) Filed: May 18, 2012

(65) Prior Publication Data

US 2013/0306776 A1 Nov. 21, 2013

(51) Int. Cl.
*E06B 9/30* (2006.01)

(52) U.S. Cl.
USPC ..... 160/170; 160/173 R; 160/168.1 R

(58) Field of Classification Search
USPC ..... 160/168.1 R, 170, 173, 178.1 R, 178.2
See application file for complete search history.

(56) References Cited

U.S. PATENT DOCUMENTS

| | | | | |
|---|---|---|---|---|
| 3,952,789 | A * | 4/1976 | Marotto | 160/168.1 R |
| 4,180,118 | A * | 12/1979 | Vecchiarelli | 160/178.2 |
| 4,463,791 | A * | 8/1984 | McClure | 160/178.2 |
| 6,289,965 | B1 * | 9/2001 | Ruggles | 160/170 |
| 6,508,293 | B1 * | 1/2003 | Huang | 160/170 |
| 6,725,897 | B2 * | 4/2004 | Palmer | 160/168.1 R |
| 6,761,203 | B1 * | 7/2004 | Huang | 160/170 |
| 6,837,294 | B2 * | 1/2005 | Cheng et al. | 160/84.04 |
| 6,889,741 | B1 * | 5/2005 | Cheng et al. | 160/170 |
| 6,991,020 | B1 * | 1/2006 | Cheng et al. | 160/168.1 R |
| 7,168,476 | B2 * | 1/2007 | Chen | 160/170 |
| 7,281,563 | B2 * | 10/2007 | Wu | 160/170 |
| 7,343,957 | B2 * | 3/2008 | Lin | 160/168.1 R |
| 7,398,815 | B2 * | 7/2008 | Liang | 160/170 |
| 7,424,905 | B2 * | 9/2008 | Lai | 160/168.1 R |
| 7,487,817 | B2 * | 2/2009 | Liang | 160/170 |
| 7,690,415 | B2 * | 4/2010 | Cheng | 160/178.2 |
| 7,717,154 | B2 * | 5/2010 | Cheng | 160/170 |
| 7,775,254 | B2 * | 8/2010 | Judkins et al. | 160/178.2 |
| 7,819,166 | B2 * | 10/2010 | Militello et al. | 160/84.04 |
| 7,866,367 | B2 * | 1/2011 | Liang et al. | 160/173 R |
| 7,950,437 | B2 * | 5/2011 | Lin | 160/168.1 R |
| 8,002,012 | B2 * | 8/2011 | Cheng | 160/170 |
| 8,245,756 | B2 * | 8/2012 | Cheng et al. | 160/170 |
| 8,297,332 | B2 * | 10/2012 | Lin | 160/170 |
| 2004/0177933 | A1 * | 9/2004 | Hillman et al. | 160/170 |
| 2007/0068636 | A1 * | 3/2007 | Yu et al. | 160/168.1 R |
| 2007/0102125 | A1 * | 5/2007 | Nien et al. | 160/178.2 |
| 2007/0119547 | A1 * | 5/2007 | Liang | 160/170 |
| 2007/0163727 | A1 * | 7/2007 | Cheng et al. | 160/170 |
| 2007/0175600 | A1 * | 8/2007 | Wilson | 160/168.1 R |
| 2007/0227677 | A1 * | 10/2007 | Yu et al. | 160/170 |
| 2007/0261798 | A1 * | 11/2007 | Hung et al. | 160/170 |
| 2008/0000592 | A1 * | 1/2008 | Huang | 160/170 |
| 2008/0264576 | A1 * | 10/2008 | Cheng | 160/168.1 V |
| 2010/0206492 | A1 * | 8/2010 | Shevick | 160/170 |
| 2012/0118515 | A1 * | 5/2012 | Chen | 160/170 |

* cited by examiner

*Primary Examiner* — Katherine Mitchell
*Assistant Examiner* — Johnnie A Shablack
(74) *Attorney, Agent, or Firm* — Alan Kamrath; Kamrath IP Lawfirm, P.A.

(57) ABSTRACT

A string-guiding structure for a curtain-reeling device substantially has a string-guiding frame mounted at an entrance of a string-guiding wheel assembly to limit the string extended from the curtain-reeling device inside the string-guiding frame and to be wound on the string-guiding wheel assembly when the string is released or collected. Therefore, the string-guiding frame depresses the oscillation and swing of the string during operation to avoid the string being jammed in the gaps of the string-guiding wheel assembly.

10 Claims, 8 Drawing Sheets

STRING-GUIDING STRUCTURE FOR A CURTAIN-REELING DEVICE

BACKGROUND OF THE INVENTION

1. Field of the Invention

The present invention relates to a string-guiding structure for a curtain-reeling device that stabilizes the movement of the string after the string goes through a string-guiding frame and winds on a string-guiding wheel assembly during operation.

2. Description of Related Art

The curtain or blade of a window shade is driven by strings of a curtain-reeling device. Because the curtain-reeling device is attached to an upper rail and the blade is suspended below the upper rail by the strings, two string-guiding wheel assemblies are mounted on two ends of the upper rail and have the strings wound thereon to keep the strings in good stability and proper tension during operation.

However, the speed of the curtain-reeling device to release or collect the strings is fast (no matter whether the curtain-reeling device is a manual or an automatic one), and the strings wound on the string-guiding wheel assemblies easily oscillate or swing to jam themselves to the string-guiding wheel assemblies. Especially one of the conventional string-guiding wheel assembly 1 is composed of multiple rollers 11 pivotally attached inside a frame 12 (as shown in FIGS. 1 and 2), and gaps exist between each of two ends of the rollers 11 and the frame 12 (to reduce the friction force between the rollers 11 and the frame 12 and to make the rollers 11 rotate freely) so that a string 13 might fall into the gaps and influence the smooth operation and tension when the string 13 moves rapidly and reciprocally on the corresponding roller 11 when the string 13 violently and transversally swings and vertically rebounds. Therefore, the conventional curtain-reeling device often malfunctions because of the operational problem that the string 13 gets stuck in the gaps between the rollers 11 and the frame 12 and then jams the curtain-reeling device having no design to limit the oscillation and swing of the string 13.

SUMMARY OF THE INVENTION

A main objective of the present invention is to provide a string-guiding structure for a curtain-reeling device, which has a string-guiding frame mounted at an entrance of a string-guiding wheel assembly to limit a string extending from the curtain-reeling device in its movement and thus to keep the string to be smoothly released or collected without getting seized in operation.

To achieve the foregoing objectives, the string-guiding structure for a curtain-reeling device comprises a string-guiding frame mounted at an entrance of a string-guiding wheel assembly to make a string, which is extended from a curtain-reeling device accommodated in an upper rail, to be limited inside the string-guiding frame and to be wound on multiple rollers inside a frame of the string-guiding wheel assembly to drive a curtain.

Further benefits and advantages of the present invention will become apparent after a careful reading of the detailed description with appropriate reference to the accompanying drawings.

DETAILED DESCRIPTION OF THE PREFERRED EMBODIMENTS

A string-guiding structure for a curtain-reeling device in accordance with the present invention substantially has a string-guiding frame mounted at an entrance of a string-guiding wheel assembly to limit a string extended from the curtain-reeling device within the string-guiding frame and to be wound on the string-guiding wheel assembly when the string is released or collected. Therefore, the string-guiding frame depresses the oscillation and swing of the string during operation to avoid the string being jammed in the gaps of the string-guiding wheel assembly.

Figure 1:
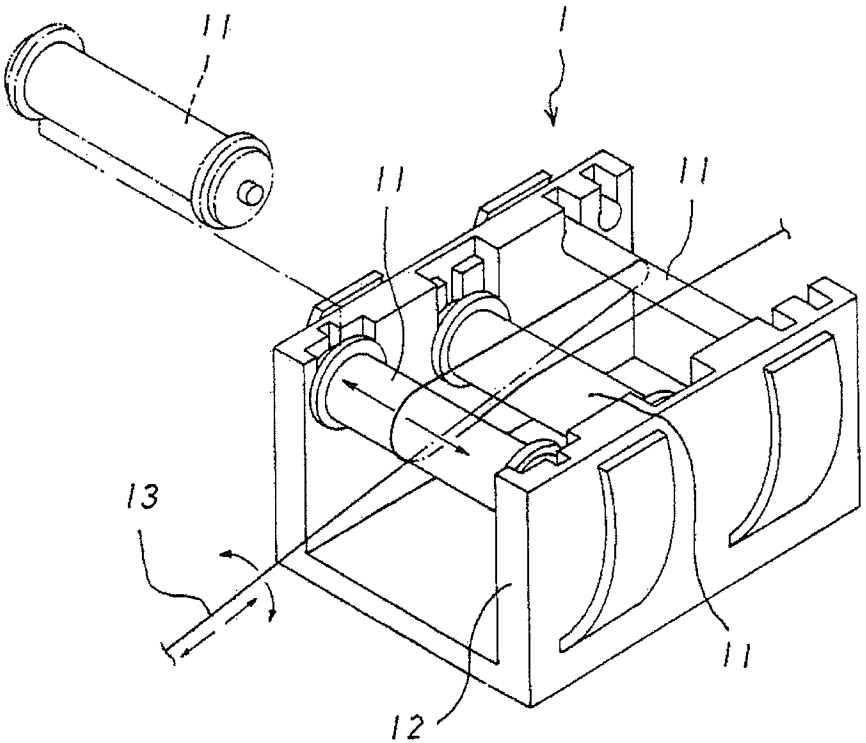
FIG. 1 PRIOR ART
FIG. 1 is a partially exploded perspective view of a string-guiding structure for a curtain-reeling device in accordance with the prior art.
Figure 2:
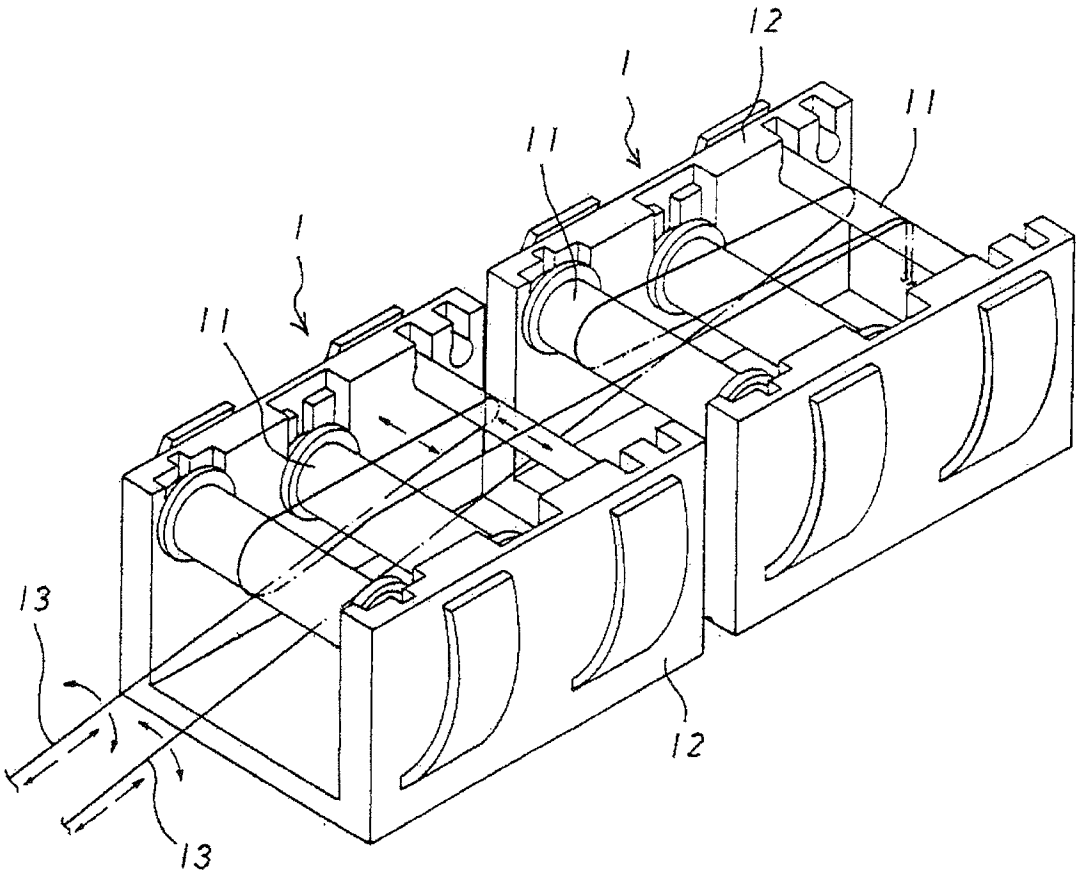
FIG.2 PRIOR ART
FIG. 2 is a perspective view of multiple sets of the string-guiding structure mounted on the curtain-reeling device in accordance with the prior art.
Figure 3:
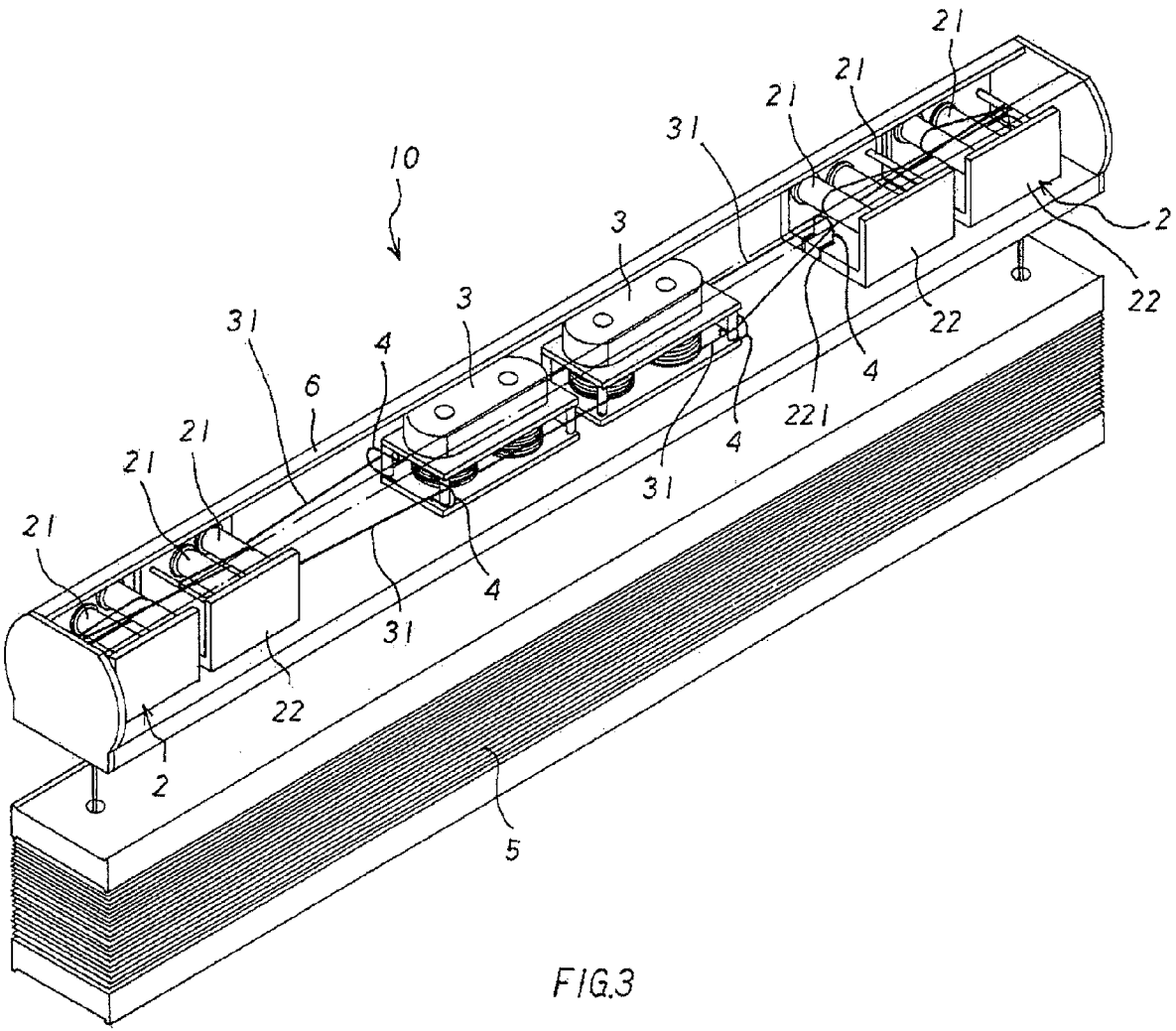
FIG. 3 is a perspective view of a curtain-reeling device having multiple string-guiding structures in accordance with the present invention.

A string-guiding structure for a curtain-reeling device substantially has a string-guiding frame 4 mounted at an entrance of a string-guiding wheel assembly 2 of a curtain structure 10 for a string 31 (as shown in FIG. 3) to limit the string 31 extended from the curtain-reeling device 3 on a upper rail 6 within the string-guiding frame 4 and to be wound on the rollers 21 of the string-guiding wheel assembly 2 to drive the blades 5. The string-guiding frame 4 depresses the oscillation and swing of the string 31 during operation to avoid the string 31 being jammed in the gaps between the rollers 21 and a frame 22 of the string-guiding wheel assembly 2.

Figure 4:
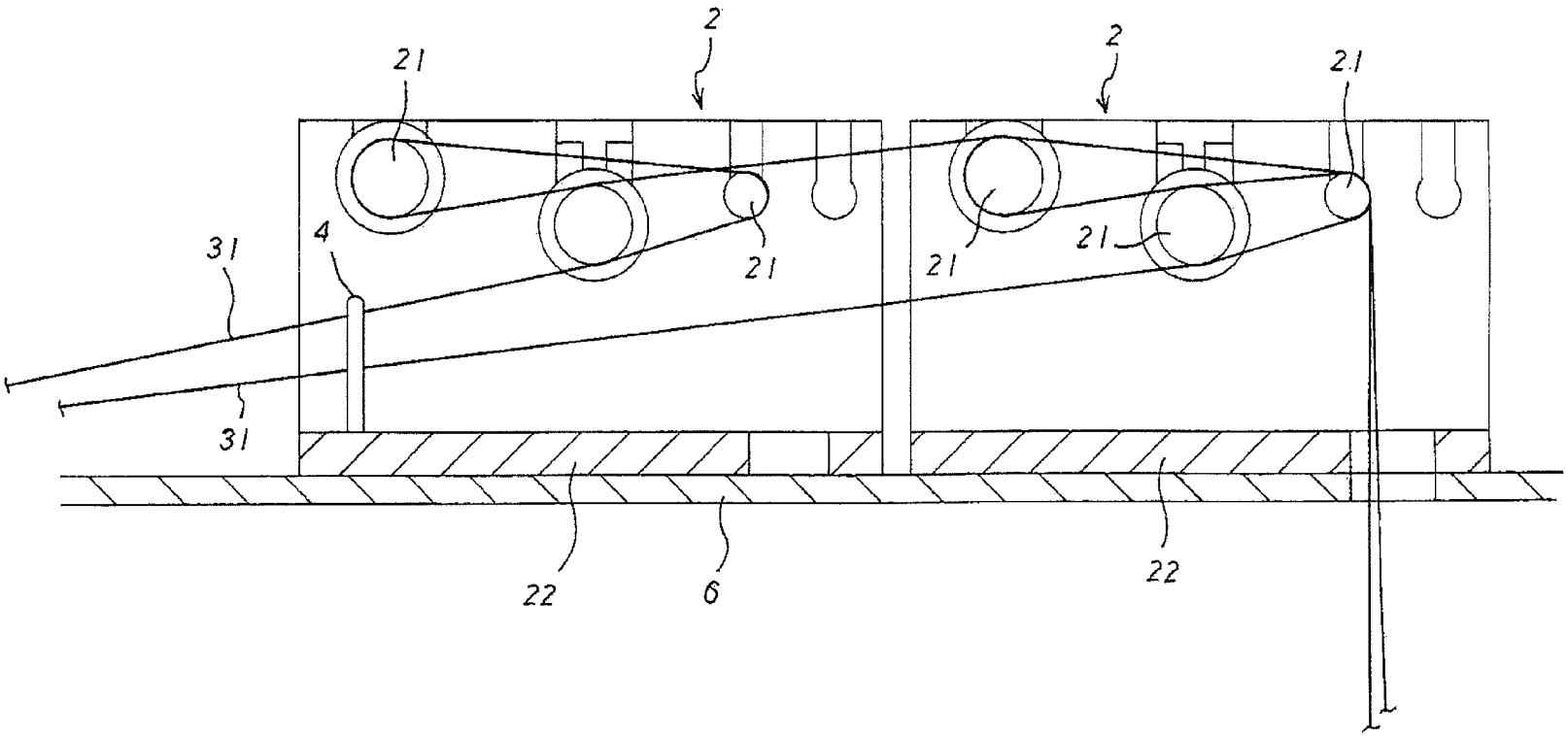
FIG. 4 is a partially cross-sectional side view of the string-guiding structure mounted at an entrance of one string-guiding wheel assembly in FIG. 3.
Figure 5:
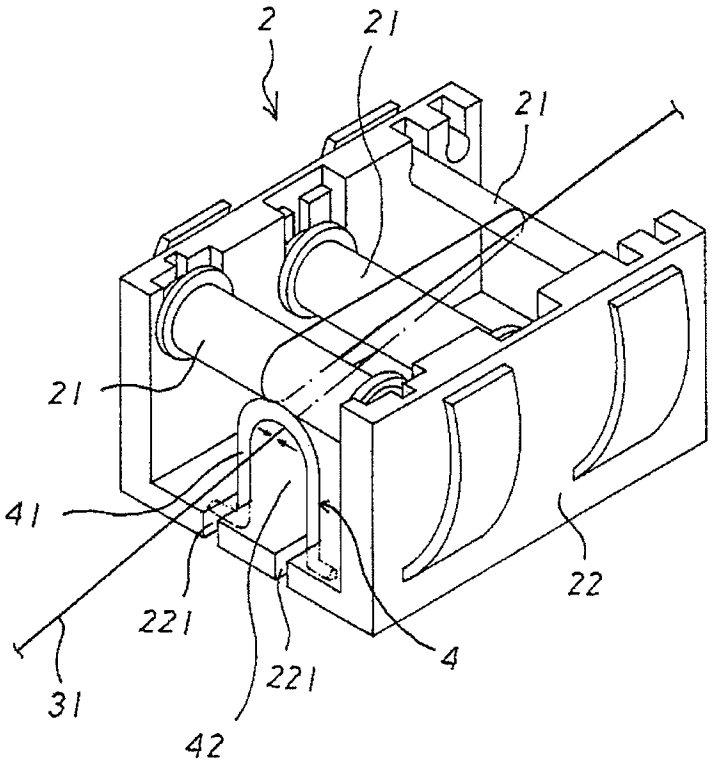
FIG. 5 is a perspective view the string-guiding structure mounted at an entrance of another string-guiding wheel assembly in accordance with the present invention.

By having the structure described above, the string-guiding frame 4 is mounted at the entrance of the string-guiding wheel assembly 2 for the string 31 (as shown in FIGS. 4 and 5), the path of the string 31 extended from the curtain-reeling device 3 to the string-guiding wheel assembly 2 is limited within the string-guiding frame 4. Thus, the string 31 is rectified to wind on the correct location of the rollers 21 to avoid the string 31 displacing to ends of the rollers 21. Moreover, the vertical rebound and transversal swing range of the string 31 is limited within the string-guiding frame 4 when the string 31 is rapidly pulled or collected so that movement of the string 31 neither exceeds the space of the frame 22 nor enters the gaps between the rollers 21 and the frame 22 to keep the curtain-reeling device durable without a jam malfunction.

Figure 6:
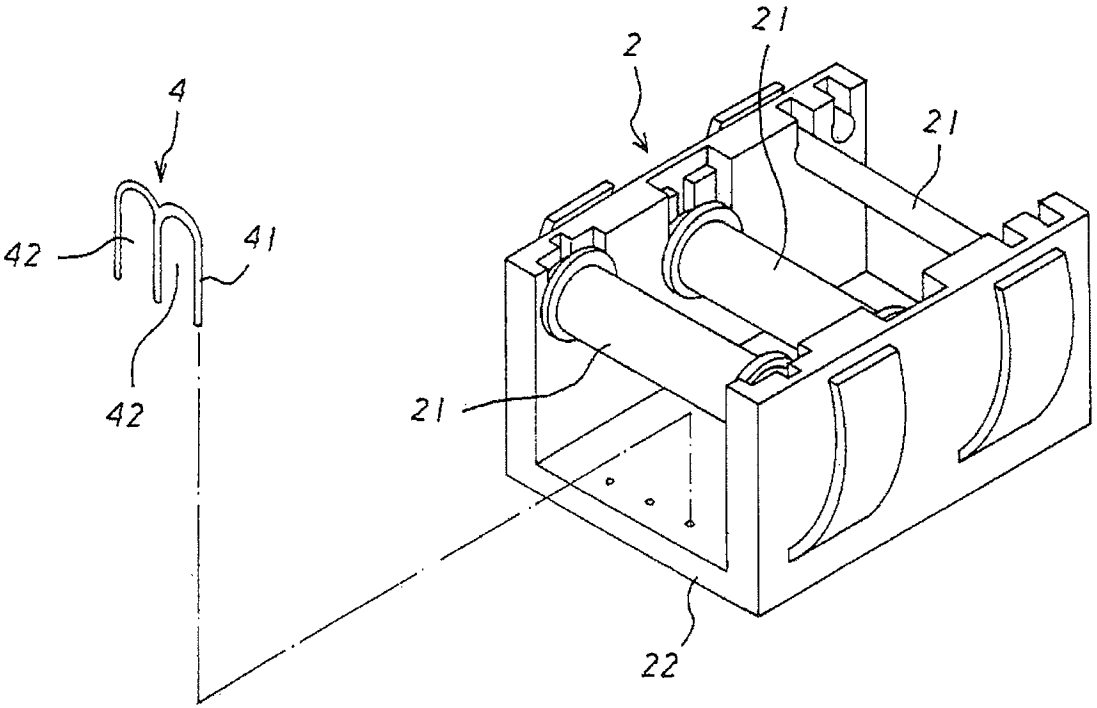
FIG. 6 is a perspective view of an embodiment of the string-guiding structure for a curtain-reeling device, with the string-guiding structure having two compartments.

The string-guiding frame 4 is a rod 41 shaped into an arch and fixed at the entrance for the string 31 of the string-guiding wheel assembly 2 (the arc-shape is to reduce friction to the string 31 and avoid obstruction to the movement of the string 31 by any angle) by inserting distal ends of the rod 41 of the string-guiding frame 4 at a bottom of the frame 22 of the string-guiding wheel assembly 2 (as shown in FIG. 6) or by directly fixing to the upper rail 6 to correspond to the string-guiding wheel assembly 2 to make the string-guiding frame 4 to define a space 42 so that the path of the string 31 extended from the string reel 3 to the string-guiding wheel assembly 2 is limited within the space 42 of the string-guiding frame 4.

Moreover, the rod 41 is shaped into an M-shape with two arches or selectively shaped into a multi-arch to define multiple limiting spaces 42 corresponding to the number of multiple strings 31 (the rod 41 is shaped by conventional technology such as bending, punch pressing, projecting shaping, etc.) to pass through one string 31 each limiting space 42 to avoid friction between the multiple strings 31.

Figure 7:
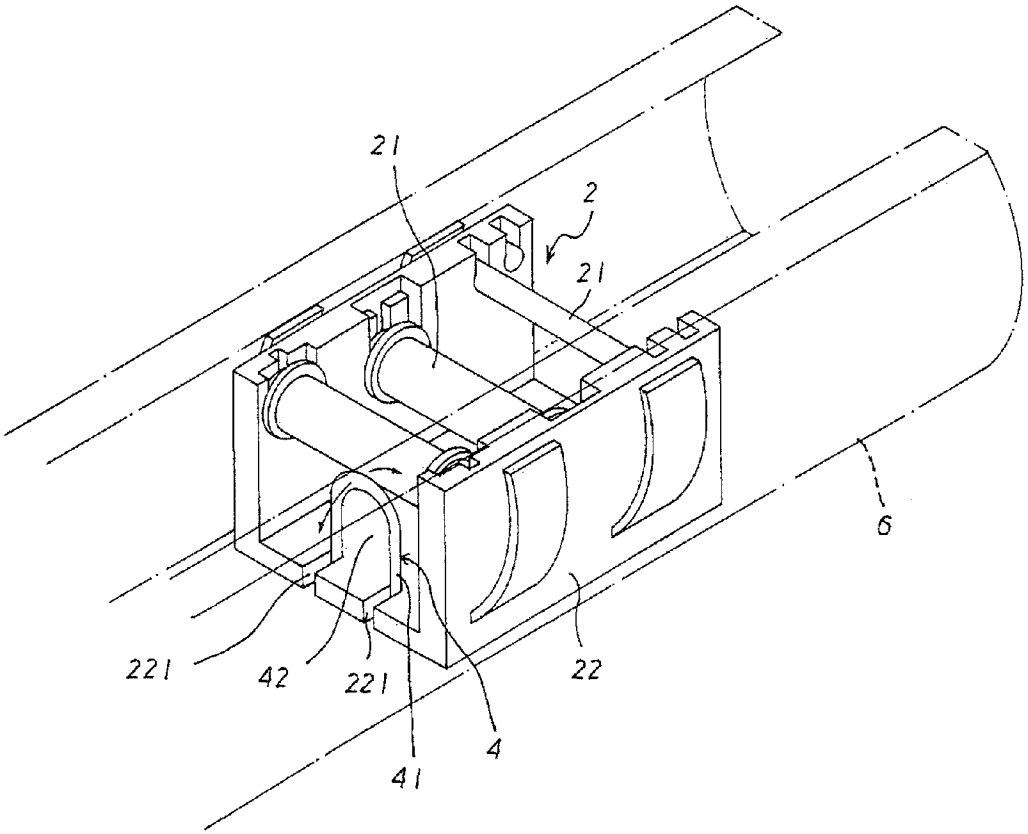
FIG. 7 is a perspective view of one embodiment of engagement of the string-guiding structure to the string-guiding wheel assembly.

Additionally, the bottom of the frame 22 of the string-guiding wheel assembly 2 has multiple notches 221 defined thereon and pivotally engaged with the rod 41 of the string-guiding frame 4 (as shown in FIG. 7) to enable the string-guiding frame 4 to swing along with the string 31 when the string 31 vibrates.

Figure 8:
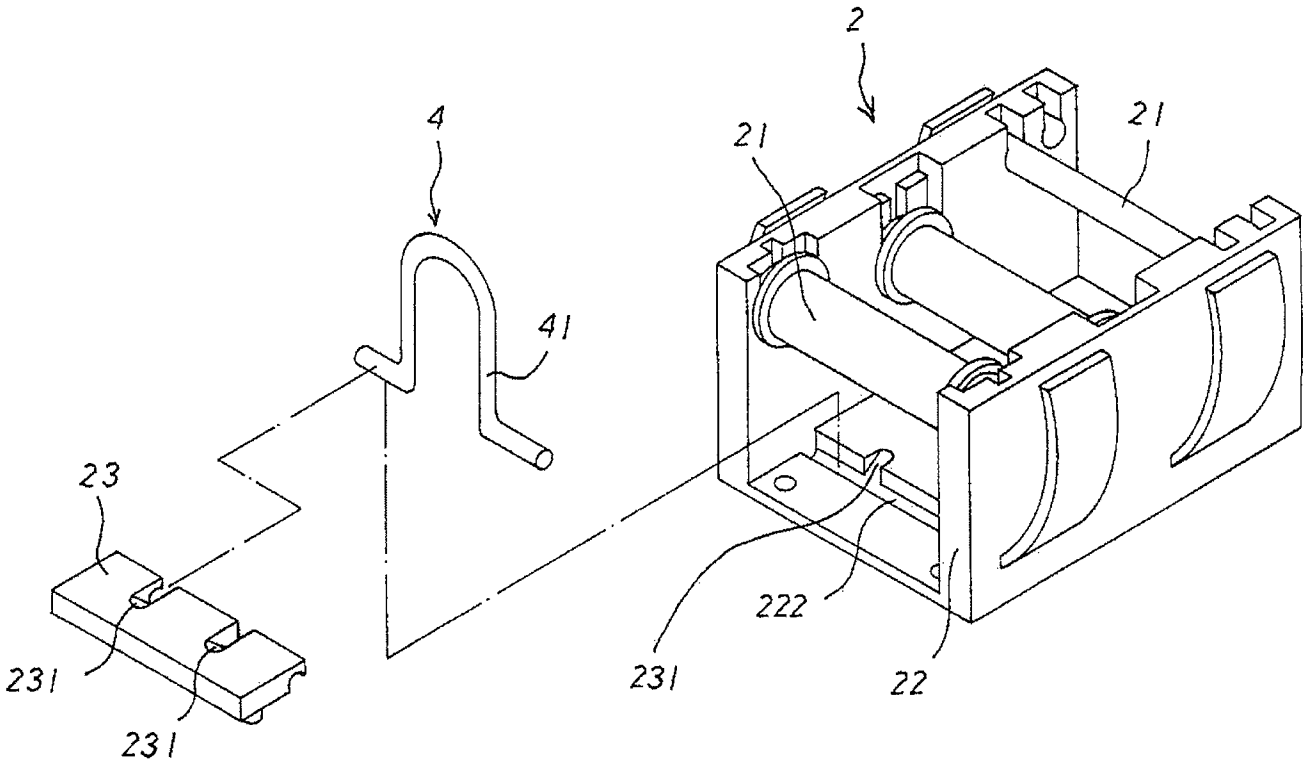
FIG. 8 is a perspective view of another embodiment of engagement of the string-guiding structure to the string-guiding wheel assembly.

In still another embodiment, the bottom of the frame 22 has a pivoting recess 222 to accommodate the two distal ends of the rod 41 of the string-guiding frame 4 (as shown in FIG. 8) and has a cover 23 matching the pivoting recess 222 to pivotally keep the string-guiding frame 4 on the frame 22. The bottom of the frame 22 and the cover 23 have two slits 231 defined respectively to be paired to receive the two distal ends of the rod 41 and to allow the string-guiding frame 4 to pivotally move within the paired two slits 231.

When a user operates the curtain structure 10, the string 31 of the string reel 3 and the blades 5 are extended or collected, and the string 31 moves along the path from the string-guiding frame 4 and the string-guiding wheel assembly 2 and passing the upper rail 6 to hang the blades 5 so that the oscillation range of the string 31 between the string reel 3 and the string-guiding wheel assembly 2 is limited by the string-guiding frame 4. The height of the string-guiding frame 4 is preferably lower than the first roller 21 of the string-guiding wheel assembly 2 and the width of the string-guiding frame 4 is preferably less than the half length of the rollers 21 to enter the string 31 into the string-guiding wheel assembly 2 from the center of the entrance and to avoid a jam caused by the string 31 being dislocated too close to the ends of the rollers 21.

Additionally, exit of the curtain-reeling device 3 also has a string-guiding frame 4 to guide the string 31 during an extending or collecting operation (as shown in FIG. 3).

Although this invention has been described in its preferred forms with a certain degree of particularity, it is understood that the present invention of the preferred forms has been made only by way of example and that numerous changes in the details of construction and the combination and arrangement of parts may be resorted to without departing from the spirit and scope of the invention.

What is claimed is:

1. A string-guiding structure for a curtain-reeling device, comprising:

an upper rail;

a string-guiding wheel assembly having multiple rollers inside an assembly frame, with the assembly frame mounted to the upper rail;

a curtain-reeling device mounted to the upper rail;

a string extending from the curtain-reeling device through an entrance of the string-guiding wheel assembly and wound on the multiple rollers of the string-guiding wheel assembly to drive a curtain; and a string-guiding frame separately formed from the assembly frame by a rod to limit movement of the string to within the string-guiding frame, wherein the rod of the string-guiding frame is shaped into an arch having two distal ends fixed at the entrance to define a limiting space for the string of the string-guiding wheel assembly, wherein the assembly frame is U-shaped and includes first and second sides extending from a bottom, with the multiple rollers extending between the first and second sides spaced above the bottom, with the two distal ends fixed relative to the bottom and with the arch extending above the bottom and spaced from and intermediate the first and second sides, with the limiting space defined by and between the bottom and the arch, with the string located within the limiting space intermediate the first and second distal ends and intermediate the arch and the bottom.

2. The string-guiding structure as claimed in claim 1, wherein the two distal ends of the string-guiding frame are separately inserted into two bores formed in the bottom of the assembly frame of the string-guiding wheel assembly to define the limiting space.

3. The string-guiding structure as claimed in claim 1, wherein the two distal ends of the string-guiding frame are separately inserted into two bores formed in the upper rail to define the limiting space.

4. The string-guiding structure as claimed in claim 1, wherein the string-guiding frame is shaped into a further arch to define multiple limiting spaces, with the further arch including one of the two distal ends and a third distal end.

5. The string-guiding structure as claimed in claim 1, wherein the bottom of the assembly frame of the string-guiding wheel assembly has multiple notches pivotally engaged with the string-guiding frame, with the two distal ends moving relative to the assembly frame of the string-guiding wheel assembly to swing the string-guiding frame along with the string when the string vibrates.

6. The string-guiding structure as claimed in claim 1, wherein the two distal ends includes two shaft ends extending in opposite directions therefrom, wherein a bottom of the assembly frame has a pivoting recess to accommodate the two shaft ends of the two distal ends of the string-guiding frame and has a cover matching the pivoting recess to pivotally keep the string-guiding frame on the assembly frame of the string-guiding wheel assembly.

7. The string-guiding structure as claimed in claim 1, wherein a height of the string-guiding frame is lower than a first roller of the multiple rollers of the string-guiding wheel assembly and a width of the string-guiding frame is less than a half length of the multiple rollers.

8. The string-guiding structure as claimed in claim 1, further comprising another string-guiding frame mounted at an exit of the curtain-reeling device.

9. The string-guiding structure as claimed in claim 1, wherein the entrance is defined by free ends of the first and second sides and the bottom of the assembly frame, with the string-guiding frame located spaced inwardly of the free ends.

10. The string-guiding structure as claimed in claim 9, wherein the multiple rollers have a minimum extent above the bottom, with the limiting space having an extent above the bottom less than the minimum extent, and wherein a width of the string-guiding frame intermediate the first and second sides is one half of a width of the multiple rollers intermediate the first and second sides.

* * * * *